United States Patent [19]

Meyers

[11] Patent Number: 4,875,311

[45] Date of Patent: Oct. 24, 1989

[54] BEAM CONSTRUCTION

[75] Inventor: Leo J. Meyers, Pittsburgh, Pa.

[73] Assignee: Sun Room Designs, Inc., Youngwood, Pa.

[21] Appl. No.: 183,972

[22] Filed: Apr. 20, 1988

[51] Int. Cl.[4] ..... E04B 7/02; E04C 3/36

[52] U.S. Cl. ..... 52/90; 52/727; 52/730; 52/DIG. 8

[58] Field of Search ..... 52/93, 727, 731, DIG. 8, 52/74, 90, 730; 47/17

[56] References Cited

U.S. PATENT DOCUMENTS

| | | | |
|---|---|---|---|
| Re. 23,693 | 8/1953 | Bergvall . | |
| 480,358 | 8/1892 | York | 52/727 |
| 1,212,073 | 1/1917 | Krueger . | |
| 1,240,284 | 9/1917 | Wolf | 52/730 |
| 2,256,050 | 9/1941 | Hansen | 47/17 |
| 2,363,862 | 11/1944 | Hancock | 52/90 |
| 2,851,747 | 9/1958 | Rolen . | |
| 3,256,662 | 6/1966 | Powers | 52/731 |
| 3,310,917 | 3/1967 | Simon | 52/90 |
| 3,605,360 | 9/1971 | Lindal . | |
| 3,660,952 | 5/1972 | Wilson | 52/90 |
| 3,964,231 | 6/1976 | Budlich . | |
| 4,128,983 | 12/1978 | Matsubara | 52/731 |
| 4,294,051 | 10/1981 | Hughes, Jr. | 52/90 |
| 4,370,841 | 2/1983 | Hayashi | 52/727 |
| 4,432,184 | 2/1984 | Holdschlag | 52/90 |
| 4,458,455 | 7/1984 | Tollstoff de Voss | 52/731 |
| 4,470,235 | 9/1984 | Jenni . | |
| 4,532,747 | 8/1985 | Koetje | 52/730 |
| 4,583,333 | 4/1986 | Minter | 52/90 |

FOREIGN PATENT DOCUMENTS

| | | | |
|---|---|---|---|
| 2712956 | 10/1978 | Fed. Rep. of Germany | 52/730 |
| 2909425 | 9/1980 | Fed. Rep. of Germany | 52/730 |
| 2354426 | 1/1978 | France | 52/730 |

*Primary Examiner*—Michael Safavi

*Attorney, Agent, or Firm*—Arnold B. Silverman; Suzanne Kikel

[57] ABSTRACT

A simulated beam construction comprises a rectangular elongated core member with several laterally arranged prongs or barbs. Wooden, laminated wooden or plastic planks with a lateral channel are fitted closely together and adapted to receive one of the barbs for the anchoring of the planks along the core member. Two L-shaped planks are arranged on opposite sides of the extrusion member such that the horizontal legs abut each other and cooperate with the other laterally arranged planks to enclose the core member.

35 Claims, 1 Drawing Sheet

BEAM CONSTRUCTION

BACKGROUND OF THE INVENTION

1. Field of the Invention

This invention relates to a composite beam construction used in the interior of an existing or new construction. More specifically, it relates to a composite beam comprising a metal core member and several wooden, or laminated wooden, or plastic members secured to the core member.

2. Description of the Prior Art

Wooden beams are generally used in ceilings for structural support and/or for decorative purposes. These wooden beams are generally an integral part of the overall structural support for the building. Structural wooden beams tend to be heavy and expensive.

In existing structures, it is generally difficult to add wooden beams to a ceiling due to lack of support therefor. Lightweight decorative laminated beams which can be secured to the interior of either existing or new construction have been known.

An example of a wooden laminated beam is disclosed in U.S. Pat. No. 3,605,360.

U.S. Pat. No. 3,605,360 discloses a prestressed vertically laminated beam of wood, which beam comprises inner metal laminated members and outer wooden laminated members. These metal and wooden members are fastened together by nails, screws, and/or bolts. This disclosure involves a complicated manner by which to secure the components of the composite beam, which beam may consist of relatively heavy materials. Additionally, the nails and/or bolts used in the beam construction are exposed thereby distracting from its aesthetic decorative appearance. The components of the beam construction of this U.S. Pat. No. 3,605,360 are generally straight and the beam remains straight in use in that the beam construction does not lend itself easily to being bent and remaining in a bent positioning.

Other wooden laminated beams have laminated layers which are generally glued together, which also does not lend the beams to being bent or remaining in a bent or curved configuration. In addition, if te laminated wooden beams of the prior art are bent or stressed, delamination occurs, whereby the laminated surfaces crack or break away from each other or the core member. Some of the conventional laminated wooden beams override the wood memory with glue. Insufficient glue strength yields delamination due to moisture or inherent internal stresses due to live and dead loads on the beam.

In lean-to type of structures, such as a sun room, solar room or greenhouse, generally a plurality of glazing bars are employed to form a structure for supporting panels, which may be glass, thermoplastic, plaster, or the like. Generally these glazing bars are all metal members whose metal surfaces are exposed on the interior of the structure. It is generally difficult to change the appearance and/or surface finish of these all metal members which may tend to make the room look and feel cold and uninviting. Also, these metal members generally do not act as a thermal insulator.

There is, therefore, lacking in the prior art a teaching of a simulated composite beam construction, which beam construction is relatively lightweight, and easily constructed. There is further lacking a composite beam construction which generally is a wooden beam which is aesthetically pleasing and attractive. There is further lacking in the prior art means for fastening the several members together for a composite beam construction which are hidden and therefore adding to its attractiveness and aesthetic appeal.

There is further lacking in the prior art in a composite beam a simple, easy way in which to attach the wooden members, laminated wooden members, or plastic members to a core eliminating the use of nails, bolts and/or nuts, and glue.

There is further lacking in the prior art a composite beam which can be bent and remain bent, and still hold the wood or laminated wooden planks together in this bent or curved configuration without delamination occurring.

There is further lacking in the prior art a metal beam with a wood appearance which metal and wood can be bent together as a unit to create a curved configuration.

There is further lacking in the prior art a glazing bar employed as a support member in a structure for a lean-to type of structure and having surfaces which are aesthetically pleasing, attractive, and which provides thermal insulation. More particularly, there is further lacking in the art, such a glazing bar comprising the composite beam described in the immediately preceding four paragraphs.

SUMMARY OF THE INVENTION

The present invention has solved the above described problems by providing a lightweight, relatively inexpensive simulated composite wooden beam construction which is easily assembled and installed in an existing or new building.

The present invention finds particular application when employed in a structure, such as a sun room, solar room, or greenhouse where a plurality of spaced apart glazing bars form a framework for supporting glass panels. The composite wooden beam of the invention may be part of a glazing bar where the wooden members are disposed on the interior of the lean-to structure to give warmth and beauty thereto.

In a preferred embodiment of the invention, a simulated beam construction comprises an elongated metal core member. Extending outwardly from this elongated core member are several laterally arranged rigid pronged projections which are coextensive with the length of the core. Wooden planks, laminated wooden planks, or plastic planks which may be of a multitude of colors are secured on the pronged projections. These planks have a lateral open channel arranged such that the channel receives one of the pronged projections thereby securing the plank to the core member. Several such planks are closely fitted together along both sides of the core member, and preferably, an L-shaped wooden plank with an extended lower horizontal leg is disposed on the two opposing lower pronged projections to completely enclose the core member and to form a continuous outer surface for the beam construction.

It is a further object of the invention to provide a beam construction wherein the elongated metal core member is preferably made of either aluminum or steel with a hollow center, and is either extruded, rolled, or otherwise formed.

It is still a further object of the invention to provide a beam construction wherein along a longitudinal direction relative to the extrusion member a plurality of varying length planks constitute a row and several rows give a "staggered look" effect.

It is still a further object of the invention to provide a decorative beam construction which can be part of a glazing bar used for supporting panels such as glass or plastic in a structure, such as a sun room, solar room, or greenhouse.

A still further object of the invention is to provide a composite beam construction having a plurality of planks, wherein each plank is substantially supported by a projection of the core member.

A broader object of the invention is to provide a composite beam construction which acts as a thermal insulation, and enhances a room by giving a feeling of beauty and warmth thereto.

A further object of the invention is to provide a composite beam with a metal core and a plurality of planks secured to the core which can be bent together, and which remain in a bent or curved position. The curved beam with its wooden planks is permanently deformed in that it has a new memory and the wooden planks are held in this curved configuration along the beam.

A further object of the invention is to provide a composite beam with a wooden or plastic surface which can be bent and remain in a bent or curved positioning while resisting the inherent problems of conventional laminated beams, such as delamination thereof.

A still further object of the invention is to provide a composite beam construction, having a core member and a plurality of planks mechanically secured to the core member.

These and other objects of the invention will be more fully understood from the following description of the invention, on reference to the illustrations appended hereto.

DESCRIPTION OF THE PREFERRED EMBODIMENTS

The term "delaminated" or "delamination" as employed herein refers to a process whereby the wooden or surface finish of a beam breaks away or is broken away from the core member.

Figure 1:
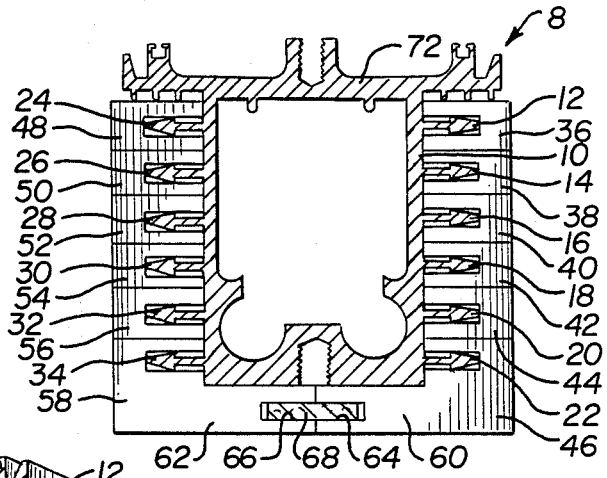
FIG. 1 is a cross-sectional view of a first embodiment of the invention.
Figure 2:
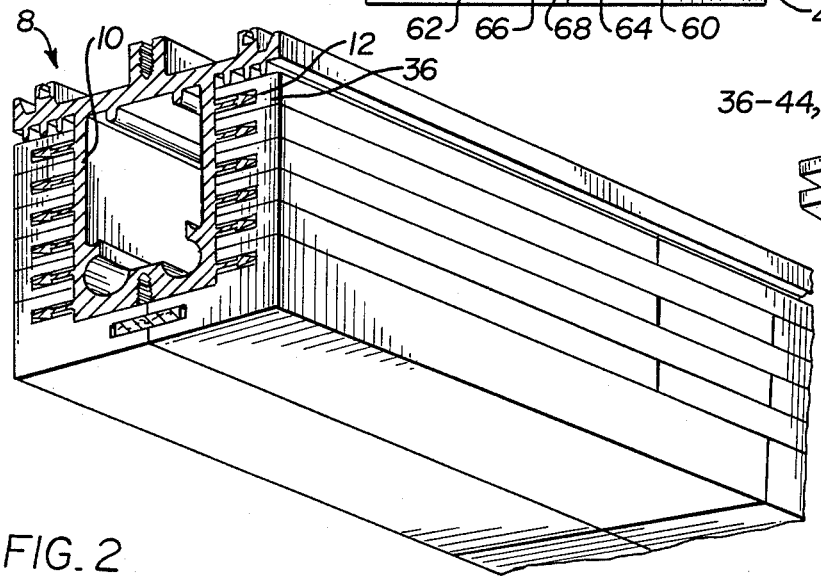
FIG. 2 is an isometric view of an embodiment of the invention of FIG. 1 illustrating the several rows of planks cooperating with the core member to form a beam wherein several planks aligned in a row give a staggering effect to the beam construction.

As illustrated particularly in FIGS. 1 and 2, a beam construction 8 comprises an elongated core member 10 which in the form shown is hollow and has a plurality of pronged projections or barbs 12, 14, 16, 18, 20, and 22 on the right side of core member 10, and barbs 24, 26, 28, 30, 32, and 34 located on the left side of core member 10 and which barbs are numbered only in FIG. 1. (For clarity, only the elements of beam construction 8 in FIG. 1 have been numbered. It is to be understood however that the elements of FIG. 2 are the same as those of FIG. 1.) Barbs 12–34 (even numbers) are equally spaced apart and extend in a lateral direction relative to core member 10, and preferably have a relatively rigid enlarged area at its extreme outward end. Barbs 12–34 are substantially rigid and are substantially a continuous piece coextensive with the length of core member 10.

Arranged on each projection 12–34 is a beam member or plank 36–58 (even numbers), respectively as shown in these FIGS. 1 and 2. These planks 36–58 have a channel (not numbered for clarity) extending laterally and opened on its inward side facing the core member 10. Each plank 36–58 is disposed on its respective barb 12–34 in such a manner that its respective barb enters the open channel of planks 36–58, and the enlarged area of barbs 12–34 having an interference fit with its respective planks 36–58 mechanically secures the planks 36–58 to its respective barb 12–34.

Figure 3:
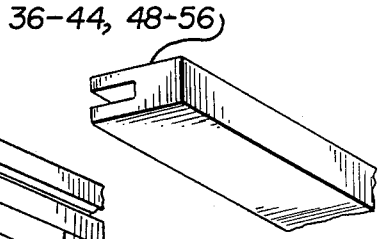
FIG. 3 is an isometric view of a portion of one of the upper planks of the invention.

As shown particularly in FIGS. 1 and 3, the several planks 36, 38, 40, 42, and 44 on the right side and planks 48, 50, 52, 54, and 56 on the left side of beam construction 8 are of a generally rectangular configuration in cross section. Lower lank members 46 and 58 to the right and left, respectively of beam construction 8 are preferably of an L-shaped configuration in cross section with a lower horizontal leg 60, 62 respectively extending a distance or length such that the downward faces of these horizontal legs 60, 62 abut each other along a centerline of core member 10.

Along these faces of legs 60 and 62 are confronting channels 64 and 66 respectively extending in a lateral direction. These legs 60 and 62 are preferably secured together by one or more splines, one of which is shown at 68 in Figure 1. Spline 68 is preferably wooden and is inserted in channels 64 and 66 of horizontal legs 60 and 62. Spline 68 may be glued in place in these channels 64, 66 of lower planks 60, 62.

Figure 4:
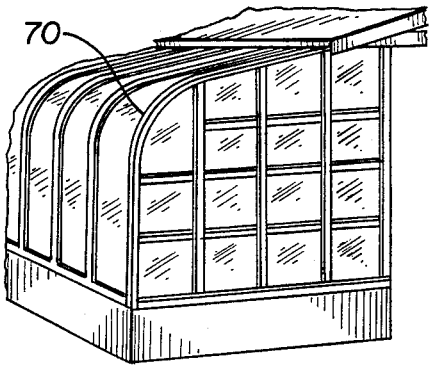
FIG. 4 is a schematic side elevational view showing the beam construction as employed in glazing bars used in a sun room structure.

Planks 36–58 are preferably solid wooden strips or of a laminated, wooden composition. However, these planks 36–58 may be made of plastic and be of a multitude of colors. Preferably, planks 36–58 have varying lengths as particularly shown in FIG. 2, and more about which will be discussed hereinafter. As already mentioned, the beam construction 8 of the invention may replace conventional wooden beams used in ceilings, however it finds particular application as part of a glazing bar for supporting panels such as glass or plastic in a sun room, solar room, greenhouse and lean-to structure. FIG. 4 illustrates an example of the present invention in a greenhouse employing glazing bars, one of which is designated at 70.

The following dimensions for beam 8 are preferred for such a glazing bar 70. Planks 36–58 preferably have a minimum length of approximately six feet and a width of approximately $\frac{3}{4}$ inch. Preferably, planks 36–44 and 48–56 have a depth of approximately $\frac{3}{8}$ inch. The outside vertical length of planks 46 and 58 is approximately $\frac{3}{4}$ inch and the length of legs 60 and 62 is approximately $1\frac{5}{8}$ inch. Slots or channels 56–78 of planks 32–54 preferably measure approximately $\frac{3}{8}$ inch long and $\frac{1}{8}$ inch deep with projections 12–34 having a width approximately 0.140 inch to cause an interference fit with planks 36–58. Preferably metal core 10 is 3 inches wide, 20 feet long, and $2\frac{7}{8}$ inches deep.

Each plank 36–58 is mounted on its respective pronged projection or barb 12–34 respectively in an interference fit such that adjacent surfaces of adjacent planks abut each other to form a continuous outer surface. These adjacent surfaces may if desired be glued together. Barbs 12–34 are generally rigid and the ends are such that its respective plank 36–58 can be easily slid onto the barb so that the plank comes close to or abuts the outer wall of core member 10 as particularly shown in FIG. 1.

Preferably, core member 10 is hollow, and generally rectangular, and along with its barbs 12–34 is a unitary aluminum extrusion.

As particularly shown in FIGS. 1 and 2, core member 10 has a structural member 72 at its uppermost portion. This structural member 72 preferably is an integral part of the aluminum extrusion of core member 10 and barbs 12–34. Structural member 72 is particularly used for the employment of beam construction 8 as a glazing bar 70 in the structure of FIG. 4. Whereas it is well known in the industry, this structural member 72 in addition to other components support a glass panel assembly (not shown) on either side of a longitudinal centerline of core member 10 of FIG. 1. Such securement for a glass panel to core member 10 of glazing bar 70 is exemplified in U.S. Pat. No. 4,724,646 issued on Feb. 16, 1988 to the same inventor and assignee as this application, which is incorporated herein by reference.

FIG. 3 best illustrates upper planks 36–44 and 48–56 of FIG. 1. The channel of each plank 36–56 is shown to be in a generally U-shaped configuration, as are the channels of lower planks 46 and 58.

FIG. 2 shows a longitudinal view of beam construction 8 where each row of planks 36–46 to the right of core member 10 consists of several such planks to form a staggered effect with each neighboring adjacent row of planks. It is to be understood that the planks 48–58 to the left of core member 10 are part of a row of several planks and form a staggered effect similar to those to the right of core member 10. For securing planks 36–58 to core member 10, preferably, each barb 12–34 is a continuous piece extending substantially the entire length of core member 10.

In assembling composite beam construction 8, each plank 36–58 is placed on its respective barb 12–34. Prior to its placement of lower planks 46 and 58 on their respective projections 22 and 34, plank 46 may be placed firs with spline 68 secured in channel 64 of plank 46. Plank 58 may then be placed on its projection 34 and spline 68. Conversely, plank 58 may be installed first, and followed by placement of plank 46.

Preferably, beam construction 8 is preassembled in a shop or factory. As a glazing bar 70 for use in a lean-to structure of FIG. 4, it is desirable to first assemble beam construction 8 and then to bend it into a predetermined curved configuration similar to that shown in FIG. 4. In order to do this, the preassembled beam construction 8 consisting of the aluminum core member 10 and the planks 36–58 are bent together in one operation. Due to the particular construction of beam construction 8 and the staggering effect of each neighboring adjacent row of planks, the planks 36–58 are retained in a curved configuration with the core member 10 while resisting delamination of beam construction 8. When wooden or laminated wooden planks are employed, the invention provides the structural integrity of a metal beam with the appearance of a wooden beam which does not delaminate, especially in a bending operation thereof.

Figure 5:
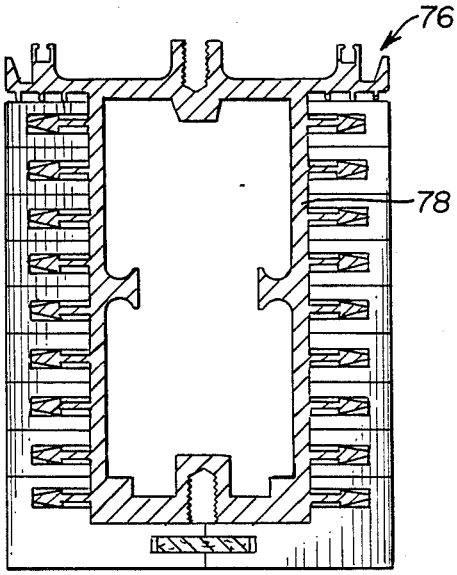
FIG. 5 is a cross-sectional view of a second embodiment of the invention.

FIG. 5 illustrates a second embodiment of the invention. A beam construction 76 comprises a core member 78. As can be seen this core member 78 is of a greater depth than core member 10 of FIGS. 1 and 2, and consists of a greater number of barbs and planks. Also, the inside of core member 78 has a different configuration than that of core member 10 to give added rigidity to beam construction 76. Other than the above described differences, beam construction 76 is the same as beam construction 8 described for FIGS. 1 through 4.

While the invention has been illustrated as consisting of several planks to form a single row, which planks have varying lengths to form a stagger effect with an adjacent row, and while such an arrangement provides ease in handling and assembling beam construction 8, it will be appreciated that a continuous plank can form a single row for beam construction 8. Also, it is not necessary to add glue between adjacent surfaces of the planks in each succeeding abutting row for proper assemblage of beam construction 8. Core member 10 and barbs 12–34 may be made of other structural materials such as steel, and can be a rolled member or a member otherwise formed. Instead of solid wooden planks, as already mentioned, plastic or wooden laminated strips may be used. If beam 8 is to be a traditional wooden type beam, then its dimensions may differ from those given for a glazing bar and it can be fastened to a surface through suitable means (not shown).

Whereas a particular embodiment of the invention has been described above for purposes of illustration, it will be evident to those skilled in the art that numerous variations of the details may be made without departing from the invention as defined in the appended claims.

I claim:

1. In a structure such as a sun room, solar room, greenhouse, or the like, a franework for supporting a panel-like comprising:

at least two spaced-apart beam members for supporting said panel-like member therebetween, each of said beam members comprising:

an elongated core member having two sides, each said side having an outer surface, a plurality of spaced-apart projections arranged on said outer surface of said each side, each said projection extending generally coextensively withsaid core member and laterally outwardly on said each outer surface of said core member, and a plurality of planks on said each side of said core member, each said plank having a lateral open channel adapted to receive one of said projections for mounting of said each plank, and said each plank abutting an adjacent plank to generally enclose said core member, said plurality of planks having different lengths, said each projection carrying a number of said planks to form a single row, and said plurality of projections forming several adjacent rows of said planks on said each side of said core member, whereby said planks of a respective row are ataggered relative to said planks of an adjacent row.

2. In a structure of claim 1, wherein said planks of said respective row have a surface abutting said planks of said adjacent row.

3. In a structure of claim 1, wherein said panel-like member is glass.

4. In a structure of claim 1, wherein said panel-like member is thermoplastic.

5. In a structure of claim 1, wherein said core member is metal.

6. In a structure of claim 1, wherein said core member is aluminum.

7. In a structure of claim 1, wherein said core member is steel.

8. In a structure of claim 1, wherein said core member is an extrusion.

9. In a structure of claim 1, wherein said core member is a rolled member.

10. In a structure of claim 1, wherein said each projection is substantially rigid, is an integral part of said core member, and has an extreme outer end with an enlarged portion for an interference fit of said each plank on said projection.

11. In a structure of claim 1, wherein said structure has an interior portion and wherein said each beam member is part of a glazing bar for said framework and is disposed on said interior of said structure.

12. In a structure of claim 1, wherein said each plank is solid wood.

13. In a structure of claim 1, wherein said each plank is laminated wood.

14. In a structure of calim 1, wherein said each plank is plastic.

15. In a structure of claim 2, wherein said each beam member is in a curved configuration, and wherein for said curved configuration, said planks are mounted on said projections and are bent as a unit whereby said configuration is retained while resisting delamination of said planks.

16. In a structure of claim 1, wherein said each beam member is a part of a glazing bar in said framework, and is disposed on the interior of said structure, and wherein said panel-like member is a glass panel.

17. In a structure of claim 1, wherein said core member is substantially rectangular in cross section, wherein said plurality of planks on said each side of said core member are arranged to form upper planks and a lower plank, said lower plank on said each side being an L-shaped member with an L-shaped configuration in cross section, and having a horizontal leg with a surface whereby said surface of said horizontal leg of one said lower plank abuts the surface of said horiontal leg of the other said lower plank, and wherein said upper planks are substantially rectangular in cross section.

18. A beam construction, comprising:

an elongated core member having two sides, each with an outer surface, and being generally rectangular in cross section, a plurality of spaced-apart projections arranged on said outer surface of said each side, each said projection extending laterally and outwardly therefrom, and a plurality of planks on said each side of said core member, each said plank having a lateral open channel adapted to receive one of said each projection for mounting of said each plank, and said each plank abutting an adjacent plank to generally enclose said core member, said plurality of planks being further arranged on said each side of said core member to form upper planks and a lower plank on said each side of said core member, said lower plank on said each side being a generally L-shaped member with an L-shape configuration in cross section, and having a horizontal leg with a surface, whereby said surface of one said lower plank abuts the surface of the other said lower plank, and said upper planks being generally rectangular in cross section.

19. A beam construction of claim 1, wherein said core member is substantially an elongated metal member.

20. A beam construction of claim 18, wherein said core member is aluminum.

21. A beam construction of claim 18, wherein said core member is steel.

22. A beam construction of claim 18, wherein said core member is an extrusion.

23. A beam construction of claim 18, wherein said core member is a rolled member.

24. A beam construction of claim 18, wherein said each projection is generally continuous and coextensive with the length of said core member.

25. A beam construction of claim 18, further comprising means in said horizontal leg of said each L-shape member for securing said L-shape members together.

26. A beam construction of claim 18, wherein said each projection is substantially rigid and comprises end means having surfaces for allowing said plank to be disposed thereon and for supporting said plank.

27. A beam construction of claim 18, wherein said each projection has an extreme outer extending into said channel of said plank for supporting said plank.

28. A beam construction of claim 18, wherein said each projection is an integral part of said core member.

29. A beam construction of claim 18, wherein said each plank is solid wood.

30. A beam construction of claim 18, wherein said each plank is laminated wood.

31. A beam construction of claim 18, wherein said each plank is made of plastic.

32. A beam construction of claim 18, wherein said each projection and said each plank substantially extend the length of said core member.

33. A beam construction of claim 18, wherein said each projection is substantially rigid and extends the length of said core member, wherein said planks have different lengths, and wherein said each projection carries a number of said planks to form a row, and said plurality of projections form aeveral adjacent rows of said planks on said each side of said core member, whereby said planks of a respective row are staggered relative to said planks of an adjacent row.

34. A beam construction, comprising:

an elongated core member being generaly rectangular in cross section and having two sides, each with an outer surface, a plurality of spaced-apart projections arranged on said outer surface of said each side, each said projection extending laterally and outwardly therefrom, and a plurality of planks on said each side of said core member, each said plank having a lateral open channel adapted to receive one of said projections for mounting of said each plank, and said each plank abutting an adjacent plank to generally enclosed said core member, said plurality of planks having different lengths, said each projection carrying a number of said planks to form a single row, and said plurality of projections forming several adjacent rows of said planks on said each side of said core member, whereby said planks of a respective row are staggered relative to said planks of an adjacent row.

35. In a structure such as a sun room, solar room, greenhouse, or the like, a framework for supporting a pane-like member comprising:

at least two spaced-apart beam members for supporting said panel-like member therebetween, each of said beam members comprising:

an elongated core member having two sides, each said side having an outer surface, a plurality of spaced-apart projections arranged on said outer surface of said each side, each said projection extending generally coextensively with said core member and laterally outwardly on said each outer surface of said core member, and a plurality of planks on said each side of said core member, each said plank having a lateral open channel adapted to receive one of said projections for mounting of said each plank, and said each plank abutting an adjacent plank to generally enclose said core member, said plurality of planks being further arranged on said each side of said core member to form upper planks and a lower plank on said each side of said core member, said lower plank on said each side being a generally L-shaped member with an L-shaped configuration in cross section, and having a horizontal leg with a surface, whereby said surface of one said lower plank abuts the surface of the other said lower plank, and said upper planks being generally rectangular in cross section.

* * * * *

UNITED STATES PATENT AND TRADEMARK OFFICE

CERTIFICATE OF CORRECTION

PATENT NO. : 4,875,311

DATED : October 24, 1989

INVENTOR(S) : LEO J. MEYERS

It is certified that error appears in the above-identified patent and that said Letters Patent is hereby corrected as shown below:

Col.1, line 43, "te" should be --the--.

Col.4, line 21, "lank" should be --plank--.

Col.5, line 42, "firs" should be --first--.

Claim 1, col.6, line 31, "franework" should be --framework--.

Claim 1, col.6, line 32, --member-- should be inserted after "panel-like".

Claim 1, col.6, line 40, "withsaid" should be --with said--.

Claim 1, col.6, line 54, "ataggered" should be --staggered--.

Claim 14, col.7, line 18, "calim" should be --claim--.

Claim 27, col.8, line 22, --end with an enlarged portion-- should be inserted after "outer".

UNITED STATES PATENT AND TRADEMARK OFFICE

CERTIFICATE OF CORRECTION

PATENT NO. : 4,875,311

DATED : October 24, 1989

INVENTOR(S) : LEO J. MEYERS

It is certified that error appears in the above-identified patent and that said Letters Patent is hereby corrected as shown below:

Claim 33, col. 8, line 41, "aeveral" should be --several--.

Claim 35, col. 8, line 68, "pane-like" should be --panel-like--.

Signed and Sealed this

Third Day of September, 1991

*Attest:*

*Attesting Officer*

HARRY F. MANBECK, JR.

*Commissioner of Patents and Trademarks*